US009284622B2

(12) United States Patent
Zeng

(10) Patent No.: US 9,284,622 B2
(45) Date of Patent: Mar. 15, 2016

(54) DEVICE AND METHOD FOR REMOVING IMPURITIES IN ALUMINUM MELT

(75) Inventor: Jianmin Zeng, Guangxi (CN)

(73) Assignee: GUANGXI UNIVERSITY, Nanning, Guangxi (CN)

( * ) Notice: Subject to any disclaimer, the term of this patent is extended or adjusted under 35 U.S.C. 154(b) by 242 days.

(21) Appl. No.: 14/006,303

(22) PCT Filed: Mar. 16, 2012

(86) PCT No.: PCT/CN2012/000325

§ 371 (c)(1),
(2), (4) Date: Nov. 5, 2013

(87) PCT Pub. No.: WO2012/126274

PCT Pub. Date: Sep. 27, 2012

(65) Prior Publication Data

US 2014/0047952 A1 Feb. 20, 2014

(30) Foreign Application Priority Data

Mar. 23, 2011 (CN) ..... 2011 1 0070724

(51) Int. Cl.

| | |
|---|---|
| ***C22B 21/00*** | (2006.01) |
| ***C22B 9/10*** | (2006.01) |
| ***F27D 27/00*** | (2010.01) |
| ***F27B 19/02*** | (2006.01) |
| ***C22B 21/06*** | (2006.01) |
| *F27D 5/00* | (2006.01) |

(52) U.S. Cl.

CPC ..... *C22B 9/10* (2013.01); *C22B 21/062* (2013.01); *F27B 19/02* (2013.01); *F27D 27/00* (2013.01); *F27D 2005/0075* (2013.01)

(58) Field of Classification Search

CPC ..... C22B 21/062; C22B 9/10; F27D 27/00; F27D 2027/002; F27D 2005/0075; F27B 19/02

See application file for complete search history.

(56) References Cited

U.S. PATENT DOCUMENTS

| | | | |
|---|---|---|---|
| 4,008,884 | A | 2/1977 | Fitzpatrick et al. |
| 5,091,149 | A | 2/1992 | Shin et al. |

(Continued)

FOREIGN PATENT DOCUMENTS

| | | | |
|---|---|---|---|
| CN | 2324159 | Y | 6/1999 |
| CN | 1362530 | A | 8/2002 |

(Continued)

OTHER PUBLICATIONS

Fujimura, Toshio. Patent Jp 59025919 A published Feb. 1984. Written translation.*

Cochran, B.P. et al. 1992 "Flux Practice in Aluminum Melting," *AFS Transactions* 88: 737-742.

(Continued)

*Primary Examiner* — George Wyszomierski
*Assistant Examiner* — Tima M McGuthry Banks
(74) *Attorney, Agent, or Firm* — Knobbe, Martens, Olson & Bear, LLP

(57) ABSTRACT

A device and a method for removing impurities in an aluminum melt are provided, in which the device includes an upper furnace body, a lower furnace body, an intermediate partition plate, a crucible, heating elements and a charging opening. The intermediate partition plate is mounted between the upper furnace body and the lower furnace body. The upper furnace body, a mixing chamber and a heating element are above the intermediate partition plate. The crucible is mounted in the lower furnace body. A heating element is provided around the lower furnace body. The mixing chamber and the crucible are connected by a jet pipe passing through the intermediate partition plate. For the device and the method, impurity removal is quick, efficiency is high and the process is closed, so there is no environmental pollution, and the aluminum melt after impurity removal may be directly cast.

6 Claims, 3 Drawing Sheets

(56) References Cited

U.S. PATENT DOCUMENTS

| | | | | |
|---|---|---|---|---|
| 5,122,184 | A | 6/1992 | Eckert et al. | |
| 6,162,388 | A * | 12/2000 | Huin et al. | 266/209 |
| 2008/0267251 | A1 * | 10/2008 | Gerszewski et al. | 373/142 |

FOREIGN PATENT DOCUMENTS

| | | | |
|---|---|---|---|
| CN | 101115852 | A | 1/2008 |
| CN | 102181658 | A | 9/2011 |
| CN | 202081152 | U | 12/2011 |
| JP | 59-025919 | A | 2/1984 |

OTHER PUBLICATIONS

Bell, S. et al. 2003 "Final Report on Refining Technologies of Aluminum" The Government of Canada Action Plan 2000 on Climate Change Minerals and Metals, Program Report No. 2003-21 (CF) in 20 pages.

Flisakowski, P.J. et al. 2001 "Improvements in Cast Shop Processing Using Pyrotek's HD-2000 and PHD-50 Rotary Injector System" *The Minerals, Metals & Materials Society* pp. 1041-1047.

Frank, R.A. et al. 2004 "In-furnace refining using pyrotek's HD-2000 and FIF-50 Rotary Injector Systems" *The Minerals, Metals & Materials Society* pp. 779-787.

* cited by examiner

DEVICE AND METHOD FOR REMOVING IMPURITIES IN ALUMINUM MELT

TECHNICAL FIELD

The present invention pertains to the field of metal casting, and in particular relates to a device and a method for removing impurities in aluminum melt.

BACKGROUND ART

In the aluminum metallurgy, smelting and casting processes, there exist unavoidably harmful impurities in aluminum and the alloys thereof. On one hand, these impurities cause discontinuity in the metallographic structure, form the crack sources inside the structural parts, decrease the strength, plasticity and impact properties of the material; on the other hand they may also become the origin of chemical or electrochemical corrosion. In addition, the impurities have a strong adsorption of hydrogen, which is a leading culprit for the pinholes and porosity in aluminum castings. The generation of the oxidative impurities in aluminum is due to the physical or chemical changes that occurs on the interface between the aluminum melt and the ambient, or due to the gas entrapped by the turbulent flow during the casting and transfer of molten aluminum, etc. The methods for removing impurities in aluminum and the alloys thereof include floatation, fluxing and filtration, etc. The principle of removing impurities is to use various adsorptive mediums that have an adsorption effect on the impurities, such as inert or active gases, liquid flux, chloride salts or a filtration medium. In the mean time, a sufficient contact of the melt with the adsorptive medium ensures a physical, chemical or mechanical action, which results in the transfer of impurities from the aluminum melt to the adsorptive medium, hence the purified aluminum melt. To remove impurities with a flux, the most common method comprises spreading the flux onto the surface of an aluminum melt to adsorb the impurities in the molten aluminum; or employing a stirring operation to enhance the contact between flux and aluminum melt. In such methods, the processing time is longer, the impurity removing effect is not satisfied; and meanwhile air is easily entrapped during the stirring operation and secondary oxidation impurities are generated. In order to improve the impurity removing effect with a flux, some methods and purifying devices have been exploited. The relevant documents are listed as follows.

*Flux Practice in Aluminum Melting, AFS Transactions,* 1992, Vol. 88, pp. 737-742. This document discloses a flux injection method. In order to overcome the disadvantage of the conventional practices for limited contact with unwanted impurities in the aluminum melt. Flux injection overcomes this limitation by delivering predetermined amounts of powdered flux beneath the melt surface. Upon leaving the lance, the flux melts into small droplets that offer a large specific surface area with the melt as they float to the surface. This accelerates flux-induced metal cleaning.

Chinese patent publication CN98205426.2, A Graphite Purifier for Removing Impurities in Aluminum Melt Liquid. The structure of the purifier comprising: a purifier rotator, which is of gear wheel type; a purifier rotator shaft, of which one end is fixed on the purifier rotator; a purifier external connection chuck, of which the bottom is joined together with the upper portion of the purifier rotator shaft, and the top is connected to an external rotation driver mechanism; a vent hole, which axially goes through the purifier rotator, the purifier rotator shaft and the purifier external connection chuck, is characterized in that comprising, on the outside of the upper-to-middle part of the rotator shaft, a jacket layer of composite tubular type, which is tightly fixed on the external face of the rotator shaft; an reinforcement mantle layer of graphite tubular type, which is tightly fixed on the external face of the jacket layer of composite tubular type.

Chinese patent publication CN01139250.9, Device for eliminating non-metallic impurity in aluminum melt by Filtration. The device mainly comprises: a resistance furnace, a crucible, an agitator, a heat insulating cover, a steel barrel and a height adjustable lifter. The steel barrel is jacked externally the crucible, then they are disposed in the resistance furnace and fixed with a refractory material. The heat insulating cover and the resistance furnace are connected via a screw. The height adjustable lifter is inserted through an insert port in the heat insulating cover. The resistance furnace mainly comprises: a heating element and a heat insulating furnace shell. The heating element is provided inside of the hearth of the resistance furnace. The space between the hearth of the resistance furnace and the heat insulating furnace mantle is filled with ceramic cotton. The working principle is as follows: the flux and the aluminum ingot are placed in two crucibles respectively and a covering agent is placed in the crucible containing the aluminum ingot. Secondly, the power supply of the heating furnace is turned on. After both of the flux and the aluminum ingot are melted, the agitator is put into the melted flux for stirring, and then the aluminum melt is ladled with a spoon and poured into a flow passage in batches so as to enter the rotating melted flux. Lastly, the agitator is removed after the transfer of the aluminum melt has completed. Particularly, when the device is running, the process is carried out as follows: firstly, an active flux and an aluminum ingot are placed in two graphite crucibles inside of the furnace respectively. It is still necessary to place a covering flux (of which the ingredients are same with those of the active flux used for filtration) in the crucible containing the aluminum ingot. After both of the flux and the aluminum ingot are melted, the agitator is placed in the graphite crucible containing the flux. Then the aluminum melt is poured into the rotating flux. During the aluminum melt being agitated and filtered, the liquid level of the flux will rise with the addition of the aluminum melt. Therefore, there is a supporter that adjusts the height of the agitator so that the impeller of the agitator is always located in the flux layer. After all of the aluminum melts are transferred into the crucible containing the flux, an active agent is placed in the graphite crucible out which the aluminum melt is transferred. After the flux is melted, the agitator is placed into the graphite crucible containing the flux via the agitator inlet. Thereafter, the aluminum melt is poured into the rotating flux again. Each of the filtrations is to repeat the above-mentioned operations. By means of implementing this process repeatedly, it is possible to distribute the impurities in the aluminum melt continuously onto the surfaces of the aluminum droplets. At the same time, the aluminum droplets will also redistribute the impurities in the aluminum droplets in the rotating flux, so that the impurities in the aluminum droplets also have an opportunity to be distributed onto the surfaces of the aluminum droplets. Thus, the impurities on the surfaces of the aluminum droplets can pass through the aluminum film-flux interface and enter into the flux layer. The aluminum melt is purified with the flux, and when the times of filtration reach 4, the efficiency for removing impurities reaches 84%, the impurities more than 7 micrometers can be removed efficiently. Therefore, this melt filtration by agitating the flux improves dynamically the impurity removal effect with a flux.

Chinese patent publication CN200680004257.8, Non-sodium-based Flux and Process for Treating Aluminum Alloys by Using the Same. The patent application provides a non-sodium-based flux, which ensures a highly deslagging effect by preventing the adhesion and sedimentation of the unreacted flux when the flux is injected into a rotary degassing device, as well as a non-sodium-based flux for treating molten aluminum alloys and a process for treating aluminum alloys by using it. The process comprises: maintaining the state of the impeller of the rotator submerged in the above-mentioned molten aluminum alloy; spraying an inert gas and the flux to the molten metal from the above nozzle, and rotating the rotator at a speed of 200-450 rpm, so that the impurities or the like in the molten metal float upwards to the surface of the molten metal together with the fine bubbles and the flux, thus the degassing and deslagging are achieved. However, either in the flux injection method or in the rotator-assistant flux injection method, the equipment is complicated. In addition, the impeller is submerged in the aluminum melt for long time and rubs against the aluminum melt, which often results in the abrasion and spalling of the material.

DISCLOSURE OF THE INVENTION

The object of the present invention is to overcome the disadvantages of the above-mentioned devices and methods, and to provide a device and a method for removing the impurities in aluminum melt with low cost, high impurity removing efficiency and low labor intensity so as to obtain aluminum castings without impurities. The present invention is achieved as follows:

A device for removing impurities in aluminum melt is characterized by comprising an upper furnace body, a lower furnace body, an intermediate partition plate, a crucible, heating elements and a charging opening, wherein the intermediate partition plate is mounted between the upper furnace body and the lower furnace body; the upper furnace body, a mixing chamber and a heating element are above the intermediate partition plate; the crucible is mounted in the lower furnace body; the heating elements are provided around the lower furnace body; the lower furnace body is provided with the charging opening and a pipeline; the upper furnace body is provided with an inlet valve and an exhaust valve; the mixing chamber and the crucible are connected to each other via a jet pipe passing through the intermediate partition plate; a ceramic seal pad is provided between the mixing chamber and the jet pipe for sealing.

A method for removing impurities in aluminum melt in the present invention is as follows: both the furnace burden and flux are placed in a crucible. The heating element of a lower furnace works for heating. After both furnace burden and the flux are melted, the liquid flux covers the surface of the aluminum melt, which can avoid the reaction between the aluminum melt and water vapor in the air, and eliminate hydrogen gas hole after solidification of casting. When the temperature of the aluminum melt is up to 700° C.-720° C., an intermediate partition plate, a jet pipe, a ceramic seal pad, a mixing chamber and an upper furnace body are mounted. The upper furnace body, the lower furnace body and the intermediate partition plate are clamped and sealed with a quick opening fixture. The heating element of the upper furnace works so that the temperature of the mixing chamber reaches 700° C. The inlet valve and the exhaust valve are opened, and inert gas is charged into the upper furnace body to expel the air in the upper furnace body in order to prevent the aluminum melt entering into the mixing chamber from being oxidized when contacting with the air. An adjustable valve is opened to charge the dry compressed air from a gas source, so that the pressure of the lower furnace body is increased gradually. The pressure of the lower furnace body is changed in accordance with the curve shown in FIG. 2. Under the action of the pressure, the aluminum melt in the crucible first stably enters into the mixing chamber along the jet pipe, and then the liquid flux enters into the mixing chamber in a manner of confined jet flow and uniformly mixes with the aluminum melt, so that the impurities in the aluminum melt are transferred to the liquid flux. When the level of the liquid flux in the crucible descends near to the inlet of the jet pipe, the jet mixing is completed. The adjustable valve is closed, another adjustable valve is opened so that the lower furnace body is connected with the atmosphere, both aluminum melt and liquid flux in the mixing chamber flow back into the crucible along the jet pipe under the action of gravity. After a while, the liquid flux re-floats on the aluminum melt, thus a working cycle is completed. The above-mentioned operations can be repeated for several times as shown in FIG. 2 till a satisfactory result is achieved.

Another method for removing impurities in aluminum melt is as follows: the intermediate partition plate, the jet pipe, the ceramic seal pad, the mixing chamber and the upper furnace body is mounted. The upper furnace body, lower furnace body and intermediate partition plate are clamped and sealed with a quick opening fixture. The heating element of the lower furnace body works for heating. The aluminum melt and liquid flux, which have been melted with other furnaces, are transferred into the crucible via the charging opening of the lower furnace body. When the temperature of the aluminum melt is up to 700° C.-720° C., the heating element of the upper furnace body works so that the temperature of the mixing chamber reaches 700° C. The inlet valve and the exhaust valve are opened. An inert gas is charged into the upper furnace body via the inlet valve to expel the air in the upper furnace body via the exhaust valve, in order to prevent the aluminum melt entering into the mixing chamber from being oxidized when contacting with the air. An adjustable valve is opened to charge dry compressed air or inert gas from a gas source into the lower furnace body, so that the pressure of the lower furnace body is increased gradually. The pressure of the lower furnace body is changed in accordance with the curve shown in FIG. 2. Under the action of the pressure, the aluminum melt in the crucible stably flows into the mixing chamber along the jet pipe, and then the liquid flux enters into the mixing chamber via the jet pipe in a manner of confined jet flow and uniformly mixes with the aluminum melt, so that the impurities in the aluminum melt are transferred to the liquid flux. When the level of the liquid flux in the crucible descends near to the inlet of the jet pipe, the adjustable valve is closed, and another adjustable valve is opened so that the lower furnace body is communicated with the atmosphere, both aluminum melt and liquid flux in the mixing chamber flow back into the crucible along the jet pipe under the action of gravity. After a while, the liquid flux re-floats on the aluminum melt, thus a working cycle is completed. The above-mentioned operations are repeated for several times till a satisfactory result is achieved.

The above-mentioned furnace burden includes aluminum alloys and aluminum matrix composites.

The above-mentioned flux includes a mixture of three or four ingredients selected from NaCl, KCl, NaF and $Na_3AlF_6$, and the composition is calculated in terms of mass percent. The melting point of the mixture is not more than 700° C.

The above-mentioned inert gas includes argon or nitrogen.

The above-mentioned mixing chamber is in a shape of a cylinder or a polygonal canister. The bottom of the mixing chamber is cambered or flat and provided with an opening.

The mixing chamber of a cylinder with a cambered bottom is the best geometrical structure.

The advantages and beneficial effects of the present invention include, but not limited to:

1. A sufficient mixing of the liquid flux and the aluminum melt is realized by utilizing the confined jet flow effect, thus a high efficiency for removal of impurity can be obtained within a short time.

2. The flux is not transported by an inert gas, so that the phenomenon that hydrogen is absorbed by the aluminum melt due to the excessive water content in the gas is avoided, and thus the inert gas of high purity is saved and the production cost is low.

3. The equipment is simple. The purified aluminum melt may be cast directly by low-pressure or other counter gravity casting processes.

4. The process can be easily realized with automatic controls and the labor intensity is decreased, 5. The process is implemented inside the device and thus no environmental pollution is caused.

Figure 1:
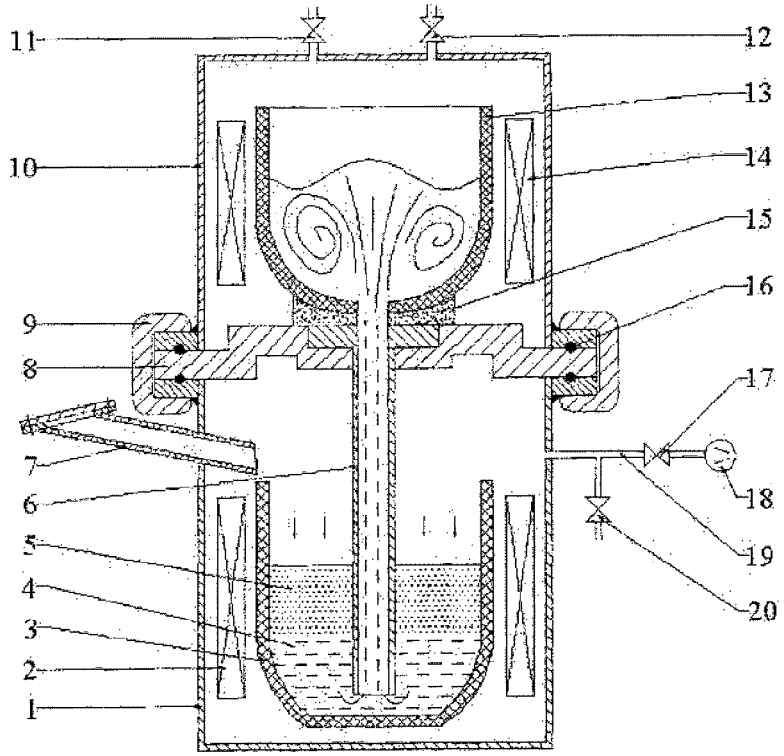
FIG. 1 is a schematic configuration of a device used in a method for removing impurities in aluminum melt of the present invention.

The marks in FIG. 1:

1—lower furnace body, 2—heating element, 3—crucible, 4—aluminum melt, 5—flux, 6—jet pipe, 7—charging opening, 8—intermediate partition plate, 9—quick opening fixture, 10—upper furnace body, 11—inlet valve, 12—exhaust valve, 13—mixing chamber, 14—heating element, 15—ceramic seal pad, 16—seal ring, 17—adjustable valve, 18—gas source, 19—pipeline, 20—adjustable valve.

DETAILED EMBODIMENTS

Hereinafter, the present invention will be further described with reference to the figures and examples.

EXAMPLE 1

I. The Configuration of a Device for Removing Impurities in Aluminum Melt

A furnace body was divided into a lower furnace body 1 and an upper furnace body 10 by a freely removable intermediate partition plate 8 at the middle part of the furnace body. A crucible 3 and a mixing chamber 13 were provided in the lower furnace body 1 and the upper furnace body 10, respectively. Two heating elements 14 and 2 were mounted around the crucible 3 and the mixing chamber 13, respectively. The crucible 3 and the mixing chamber 13 were connected through a jet pipe 6 made of SiC. The space between the mixing chamber 13 and the intermediate partition plate 8 was sealed by a refractory ceramic seal pad 15. Two seal rings 16 were provided between the upper furnace body 10, lower furnace body 1 and the intermediate partition plate 8, respectively. The upper furnace body 10, the lower furnace body 1 and the intermediate partition plate 8 were clamped and sealed by a quick opening fixture 9. An inlet valve 11 and an exhaust valve 12 were provided at the top of the upper furnace body 10. A pipeline 19 was provided on the furnace wall of the lower furnace body 1. One end of the pipeline 19 was communicated with the interior of the lower furnace body 1, while the other end was connected to adjustable valves 17 and 20 which were connected to a gas source 18 and was communicated with the atmosphere, respectively.

II. Application in the Purification of A357 Cast Alloy

1. Process Conditions

The furnace burden was A357 cast alloy, and its alloying composition by mass percent thereof were Si 7.06%, Mg 0.48%, Ti 0.14%, Be 0.06%. The alloy was formulated by 30% of virgin material and 70% of recycled material. The virgin material consisted of pure aluminum, Al—Si intermediate alloy, pure magnesium, Al—Ti intermediate alloy and Al—Be intermediate alloy. The recycled material included the gates, risers and chips cut from the castings with same compositions.

The ingredients of the flux by mass percent thereof were NaCl 40%, KCl30%, NaF10% and $Na_3AlF_6$ 20%. The formulated flux 5 was placed in a vessel made of stainless steel, and then dried and preheated at a temperature of 300° C. for 4 hours for use.

The ratio of the aluminum alloy to the flux was 2:1 by mass percent.

2. Process Operations

Figure 2:
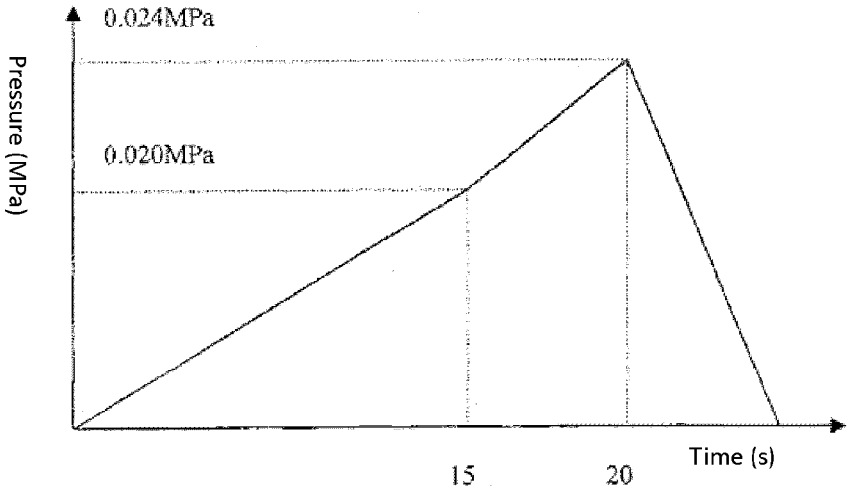
FIG. 2 is a process curve in the Examples.
Figure 3:
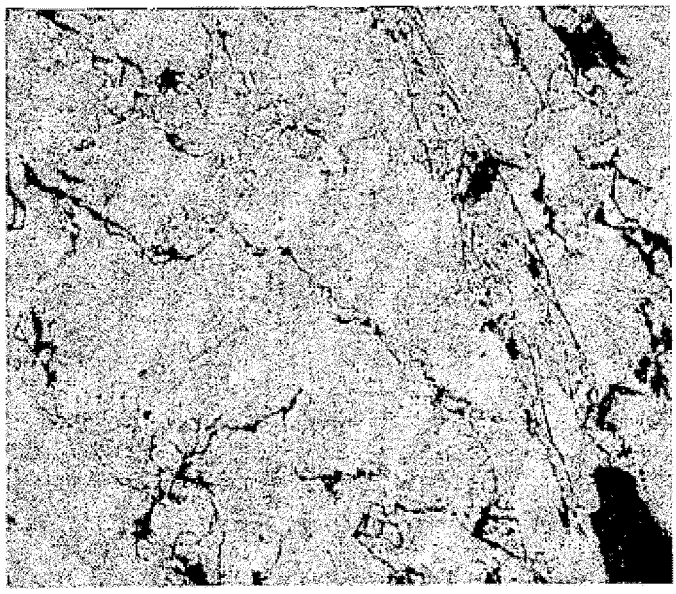
FIG. 3 is the metallograph of A357 aluminum cast alloy before removing impurities.
Figure 4:
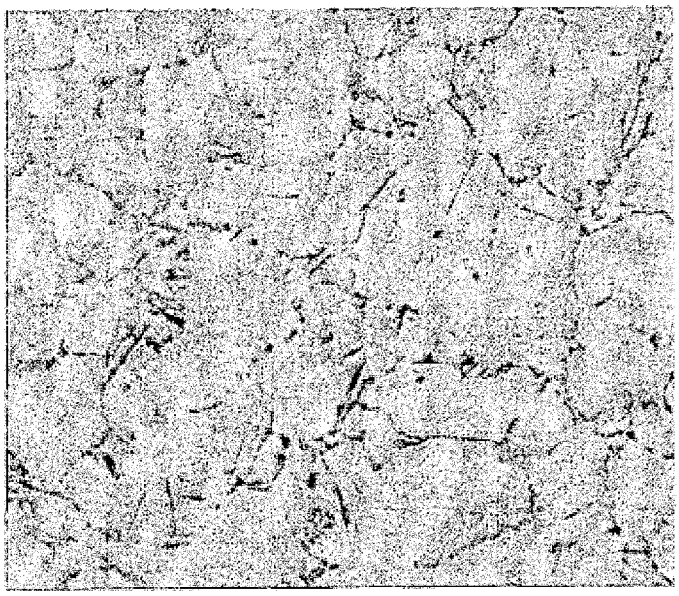
FIG. 4 is the metallograph of A357 aluminum cast alloy after removing impurities.

The furnace burden was placed in the crucible 3. Half of the recycled aluminum, Al—Si intermediate alloy, pure aluminum, Al—Ti intermediate alloy and Al—Be intermediate alloy and the remaining half of the recycled aluminum were added thereto in this order. The flux 5 was spread on the surface of the furnace burden. The heating element 2 of the lower furnace body worked for heating, so that both furnace burden 4 and flux 5 were melted. The liquid flux 5 covered the aluminum melt 4, so as to avoid the reaction between the aluminum melt 4 and the water vapor, and generation of hydrogen gas hole after solidification. When the temperature of the aluminum melt 4 was up to 710° C., the pure magnesium was put into it by a bell jar. The intermediate partition plate 8, the jet pipe 6, the ceramic seal pad 15, the mixing chamber 13 and the upper furnace body 10 were mounted thereafter. The upper furnace body 10, lower furnace body 1 and intermediate partition plate 8 were clamped and sealed with a quick opening fixture 9. The heating element 14 worked so that the temperature of the mixing chamber 13 reached 700° C. The inlet valve 11 and the exhaust valve 12 were opened. The inert gas nitrogen was charged via the inlet valve 11 into the upper furnace body 10 to expel the air in the upper furnace body 10 via the exhaust valve 12, in order to prevent the aluminum melt 4 entering into the mixing chamber 13 from being oxidized when contacting with the air. The adjustable valve 17 was opened to charge the inert gas from the gas source 18 into the lower furnace body 1, so that the pressure of the lower furnace body 1 was increased gradually. The pressure of the lower furnace body 1 was changed in accordance with the curve shown in FIG. 2. Under the action of the pressure, the aluminum melt 4 in the crucible 3 stably flowed into the mixing chamber 13 along the jet pipe 6, and then the liquid flux 5 entered into the mixing chamber 13 via the jet pipe 6 in a manner of confined jet flow and uniformly mixed with the aluminum melt 4, so that the impurities in the aluminum melt 4 were transferred to the liquid flux 5. When the level of the liquid flux 5 in the crucible 3 descended near to the inlet of the jet pipe 6, the adjustable valve 17 was closed, the adjustable valve 20 was opened so that the lower furnace body 1 was communicated with the atmosphere. The mixture of aluminum melt 4 and the liquid flux 5 in the mixing chamber 13 flowed back into the crucible 3 along the jet pipe 6 under the action of gravity. After a while, the liquid flux 5 re-floated on the aluminum melt 4, thus one working cycle was completed. The above-mentioned operations were repeated for 3 times in accordance with FIG. 2, thereby a satisfactory impurity removing effect could be achieved. After completing the treatment, the adjustable valve 20, the inlet valve 11 and the exhaust valve 12 were closed. Then the quick opening fixture 9 was opened. The upper furnace body 10 and the mixing chamber 13 were removed off. The liquid flux 5 floating on the aluminum melt 4 in the jet pipe 6 was removed with special tools. Then, castings could be manufactured by conventional low-pressure casting or other counter-gravity casting processes. The metallographic comparative images of the A357 aluminum cast alloy before and after removing impurities are shown in FIGS. 3 and 4, respectively.

EXAMPLE 2

I. The Configuration of a Device for Removing Impurities in Aluminum Melt

A furnace body was divided into a lower furnace body 1 and an upper furnace body 10 by a freely removable intermediate partition plate 8 at the middle part of the furnace body. A crucible 3 and a mixing chamber 13 were provided in the lower furnace body 1 and the upper furnace body 10, respectively, wherein the mixing chamber 13 had a cylinder structure with a cambered bottom. Two heating elements 14 and 2 were mounted around the crucible 3 and the mixing chamber 13, respectively. The crucible 3 and the mixing chamber 13 were connected via a jet pipe 6 made of SiC. The space between the mixing chamber 13 and the intermediate partition plate 8 was sealed by a refractory ceramic seal pad 15. Two seal rings 16 were provided between the upper furnace body 10, lower furnace body 1 and the intermediate partition plate 8, respectively. The upper furnace body 10, the lower furnace body 1 and the intermediate partition plate 8 were clamped and sealed by a quick opening fixture 9. An inlet valve 11 and an exhaust valve 12 were provided at the top of the upper furnace body 10. A pipeline 19 was provided on the furnace wall of the lower furnace body 1. One end of the pipeline 19 was communicated with the interior of the lower furnace body 1, while the other end was connected with adjustable valves 17 and 20 which were connected to a gas source 18, and was communicated with the atmosphere, respectively.

II. Application in the Impurity Removing and Recovery of 6063 Aluminum Alloy

1. Process Conditions:

The furnace burden was the secondary 6063 aluminum alloy, which consisted of the residual of extruded profiles that was out of service and the scraps from cutting processing.

The ingredients of the flux by mass percent thereof were NaCl 40%, KCl 30%, NaF10% and $Na_3AlF_6$ 20%. The formulated flux 5 was placed in a vessel made of stainless steel, and then dried and preheated at a temperature of 300° C. for 4 hours for use. The mass ratio of the furnace burden to the flux was 2.5:1.

2. Process Operations

Figure 5:
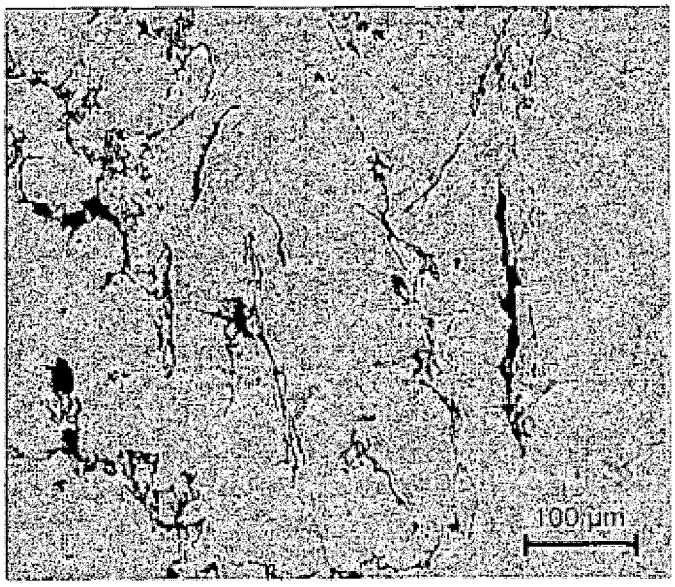
FIG. 5 is the metallograph of 6063 aluminum alloy before removing impurities.
Figure 6:
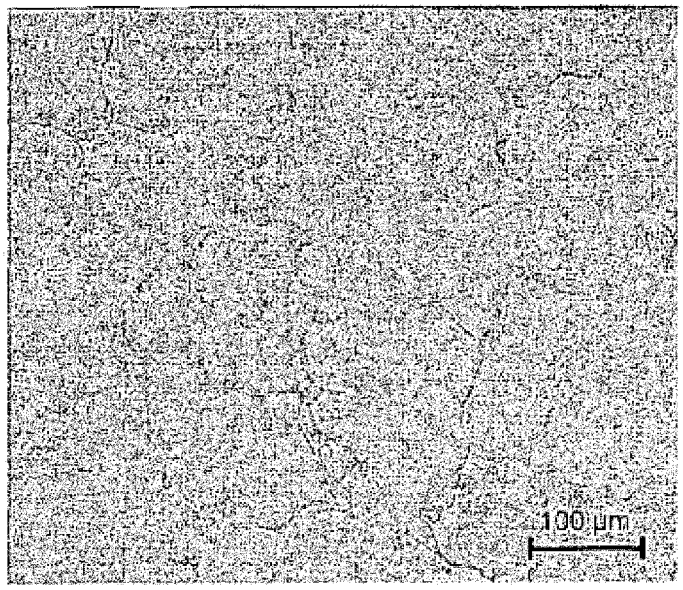
FIG. 6 is the metallograph of 6063 aluminum alloy after removing impurities.

The furnace burden was placed in the crucible 3. The heating element 2 of the lower furnace worked for heating. When the furnace burden turned into mushy state, the flux 5 was spread on the surface of the mushy aluminum melt 4. During melting, the flux 5 was melted into a liquid first and covered the melting aluminum melt 4, so as to avoid the reaction between the aluminum melt 4 and water vapor, and generation of the hydrogen gas hole after solidification. When the temperature of the aluminum melt 4 was up to 720° C., the intermediate partition plate 8, the jet pipe 6, the ceramic seal pad 15, the mixing chamber 13 and the upper furnace body 10 were mounted. The heating element 14 of the upper furnace body 10 worked so that the temperature of the mixing chamber 13 reached 700° C. The inlet valve 11 and the exhaust valve 12 were opened, the inert gas argon was charged via the inlet valve 11 into the upper furnace body 10 so as to expel the air in the upper furnace body 10, in order to prevent the aluminum melt 4 entering into the mixing chamber 13 from being oxidized when contacting with the air. The adjustable valve 17 was opened to charge dry compressed air from the gas source 18 into the lower furnace body 1, so that the pressure of the lower furnace body 1 was increased gradually. The pressure of the lower furnace body 1 was changed in accordance with the curve shown in FIG. 2. Under the action of the pressure, the aluminum melt 4 in the crucible 3 stably flowed into the mixing chamber 13 along the jet pipe 6, and then the liquid flux 5 entered into the mixing chamber 13 through the jet pipe 6 in a manner of confined jet flow and uniformly mixed with the aluminum melt 4, so that the impurities in the aluminum melt 4 was transferred to the liquid flux 5. When the level of the liquid flux 5 in the crucible 3 descended near to the inlet of the jet pipe 6, the adjustable valve 17 was closed, the adjustable valve 20 was opened so that the lower furnace body 1 was communicated with the atmosphere. The mixture of aluminum melt 4 and liquid flux 5 in the mixing chamber 13 flowed back into the crucible 3 along the jet pipe 6 under the action of gravity. After a while, the liquid flux 5 re-floated on the aluminum melt 4, thus one working cycle was completed. The above-mentioned operations were repeated for 3 times, then a satisfactory impurity removing effect could be achieved. The comparative metallographic images of the aluminum melt 4 before and after the impurity removing are shown in FIGS. 5 and 6 respectively.

EXAMPLE 3

Based on the configuration of the device for removing impurities in aluminum melt used in Example 2, a charging opening, which could be opened and closed, was provided on the furnace wall of the lower furnace body 1 additionally. The furnace burden was secondary 6063 aluminum alloy, which consisted of the residual of extruded profiles that was out of service and the scraps from cutting processing. The ingredients by mass percent thereof in the flux 5 were NaCl 50%, KCl 20%, NaF 10% and $Na_3AlF_6$ 20%. The ratio of furnace burden and flux is 2.2:1 by mass percentage. While the furnace burden 4 and the flux 5 were melted with another furnaces through a conventional method, the heating elements 14 and 2 of the upper and lower furnace body 10 and 1 of the device for removing impurities from aluminum melt worked so that the temperature of the crucible reached 720° C., and the temperature of the mixing chamber 13 reached 700° C. Then the charging opening 7 was opened, and the aluminum melt 4 and the flux 5 were poured into the crucible 3 through the charging opening 7. The flux floated on the aluminum melt. The inlet valve 11 and the exhaust valve 12 were opened. The inert gas argon was charged via the inlet valve 11 into the upper furnace body 10 so as to expel the air in the upper furnace body 10, in order to prevent the aluminum melt 4 entering into the mixing chamber 13 from being oxidized when contacting with the air. Then the adjustable valve 17 was opened to charge dry compressed air from the gas source 18 into the lower furnace body 1, so that the pressure of the lower furnace body 1 was increased gradually. The pressure of the lower furnace body 1 was changed in accordance with the curve shown in FIG. 2. Under the action of the pressure, the aluminum melt 4 in the crucible 3 stably flowed into the mixing chamber 13 along the jet pipe 6, and then the liquid flux 5 entered into the mixing chamber 13 through the jet pipe 6 in a manner of confined jet flow and uniformly mixed with the aluminum melt 4, so that the impurities in the aluminum melt 4 was transferred to the liquid flux 5. When the level of the liquid flux 5 in the crucible 3 descended near to the inlet of the jet pipe 6, the adjustable valve 17 was closed, the adjustable valve 20 was opened so that the lower furnace body 1 was communicated with the atmosphere. The mixture of aluminum melt 4 and the liquid flux 5 in the mixing chamber 13 flowed back into the crucible 3 along the jet pipe 6 under the action of gravity. After a while, the liquid flux 5 re-floated on the aluminum melt 4, thus one working cycle was completed. The above-mentioned operations were repeated for 3 times, thereby a satisfactory impurity removing effect could be achieved.

The invention claimed is:

1. A device for removing impurities in aluminum melt comprising:
- an upper furnace body,
- a lower furnace body,
- an intermediate partition plate,
- a crucible,
- heating elements, and
- a charging opening,
- wherein:
- the intermediate partition plate is mounted between the upper furnace body and the lower furnace body;
- the upper furnace body, a mixing chamber and a heating element are provided above the intermediate partition plate;
- the crucible is mounted inside the lower furnace body;
- a heating element is provided in the lower furnace body;
- the lower furnace body is provided with the charging opening and a pipeline;
- the upper furnace body is provided with an inlet valve and an exhaust valve;
- the mixing chamber and the crucible are connected via a jet pipe passing through the intermediate partition plate; and
- a ceramic seal pad is provided between the mixing chamber and the jet pipe for sealing.

2. The device for removing impurities in aluminum melt according to claim 1, wherein the mixing chamber is a cylinder or a polygonal canister, wherein the bottom of the mixing chamber is cambered or flat and comprises an opening.

3. A method for removing impurities in aluminum melt with the device according to claim 1, comprising the following steps:
- placing a furnace burden and a flux in the crucible,
- heating the lower furnace body with the heating element, so that the furnace burden and the flux are melted and liquid flux covers aluminum melt;
- mounting the intermediate partition plate, the jet pipe, the ceramic seal pad, the mixing chamber and the upper furnace body when the temperature of the aluminum melt is up to 700° C.-720° C.,
- clamping and sealing the upper furnace body, the lower furnace body and the intermediate partition plate are clamped and sealed with a quick opening fixture,
- heating the upper furnace body with the heating element so that the temperature of the mixing chamber reaches 700° C.;
- opening the inlet valve and the exhaust valve, wherein an inert gas is charged via the inlet valve into the upper furnace body so as to expel air in the upper furnace body via the exhaust valve, in order to prevent the aluminum melt entering into the mixing chamber from being oxidized when contacting with the air;
- opening an adjustable valve to charge dry compressed air or inert gas from a gas source into the lower furnace body, so that the pressure of the lower furnace body is increased gradually;
- wherein, under the increase of the pressure, the aluminum melt in the crucible stably flows into the mixing chamber along the jet pipe, then the liquid flux enters into the mixing chamber via the jet pipe in a manner of confined jet flow and uniformly mixes with the aluminum melt, so that the impurities in the aluminum melt are transferred to the liquid flux;
- closing the adjustable valve when a level of the liquid flux in the crucible descends near to the inlet of the jet pipe; and
- opening another adjustable valve so that the lower furnace body is communicated with a surrounding atmosphere;
- wherein the mixture of aluminum melt and the liquid flux in the mixing chamber flows back into the crucible along the jet pipe under gravity, and the liquid flux re-floats on the aluminum melt, whereby a working cycle is completed, and the above-mentioned steps are repeated for several times until a satisfactory impurity removing effect is achieved.

4. The method for removing impurities in aluminum melt according to claim 3, wherein the furnace burden comprises aluminum alloys and aluminum matrix composites.

5. The method for removing impurities in aluminum melt according to claim 3, wherein the flux comprises a mixture of three or four ingredients selected from the group consisting of NaCl, KCl, NaF and $Na_3AlF_6$, wherein the melting point of the mixture is not more than 700° C.

6. A method for removing impurities in aluminum melt with the device according to claim 1, comprising the following steps:
- mounting the intermediate partition plate, the jet pipe, the ceramic seal pad and the mixing chamber,
- mounting the upper furnace body,
- clamping and sealing the upper furnace body, the lower furnace body and the intermediate partition plate with a quick opening fixture,
- heating the lower furnace body with the heating element in the lower furnace body;
- opening the charging opening,
- pouring an aluminum melt and a liquid flux, both of which have been melted by another furnace into the crucible via the charging opening of the lower furnace body;
- heating the upper furnace body with the heating element when the temperature of the aluminum melt is up to 700° C.-720° C. so that the temperature of the mixing chamber reaches 700° C.;
- opening the inlet valve and the exhaust valve, wherein an inert gas is charged via the inlet valve into the upper furnace body so as to expel air in the upper furnace body via the exhaust valve, in order to prevent the aluminum melt entering into the mixing chamber from being oxidized when contacting with the air;

opening an adjustable valve to charge dry compressed air or an inert gas from a gas source into the lower furnace body, so that the pressure of the lower furnace body is increased gradually;

wherein, under the increase of the pressure, the aluminum melt in the crucible stably flows into the mixing chamber along the jet pipe, then the liquid flux enters into the mixing chamber via the jet pipe in a manner of confined jet flow and uniformly mixes with the aluminum melt, so that the impurities in the aluminum melt are transferred to the liquid flux;

closing the adjustable valve when a level of the liquid flux in the crucible descends near to the inlet of the jet pipe, and opening another adjustable valve so that the lower furnace body is communicated with a surrounding atmosphere;

wherein the mixture of aluminum melt and the liquid flux in the mixing chamber flows back into the crucible along the jet pipe under gravity, and the liquid flux re-floats on the aluminum melt, whereby a working cycle is completed, and the above-mentioned steps are repeated for several times until a satisfactory impurity removing effect is achieved.

* * * * *